United States Patent [19]

Eigemeier

[11] 4,353,582

[45] Oct. 12, 1982

[54] DOOR LOCK WITH TWO LOCK CASE PORTIONS DISPOSED IN PARALLEL OPPOSED RELATIONSHIP

[76] Inventor: Willi Eigemeier, Friedrichshaller Strasse 66/1, Bad Friedrichshall D-7107, Fed. Rep. of Germany

[21] Appl. No.: 193,948

[22] PCT Filed: Jan. 15, 1979

[86] PCT No.: PCT/EP79/00001

§ 371 Date: Mar. 18, 1980

§ 102(e) Date: Mar. 18, 1980

[87] PCT Pub. No.: WO80/00359

PCT Pub. Date: Mar. 6, 1980

[30] Foreign Application Priority Data

Jul. 31, 1978 [DE] Fed. Rep. of Germany ..... 2833622

[51] Int. Cl.[3] ..... E05B 65/06; E05C 1/12

[52] U.S. Cl. ..... 292/169.15; 292/169.22; 292/DIG. 61; 70/120

[58] Field of Search ..... 292/165, 169, 169.11, 292/169.12, 169.13, 169.14, 169.15, 169.16, 169.17, 169.19, 169.21, 169.22, 173, DIG. 61; 70/120, 129, 134, DIG. 54, DIG. 55, 107

[56] References Cited

U.S. PATENT DOCUMENTS

| | | | |
|---|---|---|---|
| 442,982 | 12/1890 | Keil | 70/DIG. 54 |
| 1,744,960 | 1/1930 | Garbell | 292/80 |
| 2,924,474 | 2/1960 | Lange | 282/128 |
| 3,773,370 | 11/1973 | Jerile | 292/169.21 |
| 3,797,870 | 3/1974 | Beckman | 292/DIG. 38 |

FOREIGN PATENT DOCUMENTS

| | | |
|---|---|---|
| 324149 | 8/1975 | Austria . |
| 343181 | 6/1927 | Belgium . |
| 1087487 | 8/1960 | Fed. Rep. of Germany . |
| 2222875 | 10/1974 | France . |
| 1149668 | 4/1969 | United Kingdom . |

*Primary Examiner*—Robert L. Wolfe
*Attorney, Agent, or Firm*—Daley & Brandt

[57] ABSTRACT

In a door lock with two case parts disposed in parallel opposed relationship the follower designed as an injection molded synthetic resin part is resilient in itself owing to a supported follower portion, the spring for the spring bolt and for the tumbler being formed by a base structure (42, 42*a*) and the support for a fitting to be mounted later on being offered by sleeves (14, 15) which are provided above and below the follower both at the lock case bottom and at the inside of the lock cover.

The spring-like action of the follower is achieved in that the bent follower leg (26) slidingly bears against an inclined supporting surface of an abutment (27) while curving inwardly or outwardly upon radial movement of the follower.

Good fit of the lock in the pocket provided in the door is achieved by ribs (11, 12, 13) on the outer surfaces of the lock case.

Inexpensive fabrication and at the same time the highest possible precision is ensured by the fact that the lock with all its interior parts is fabricated from thermoplastic synthetic resin material.

15 Claims, 35 Drawing Figures

1
4
9
2
9
34
9
22
9
9
35
9
9
4
Y 3
1
5
6
3

DOOR LOCK WITH TWO LOCK CASE PORTIONS DISPOSED IN PARALLEL OPPOSED RELATIONSHIP

The invention relates to a door lock in which the follower, the spring bolt and the tumbler are each held in the desired positions by means of a device designed without special bias while they nevertheless may exert resilience, and the lock case portions disposed in parallel opposed relationship have sleeves above and below the handle follower, and the two case portions are secured to each other by undercuts or by engaging tabs.

In the known door locks the follower is held under tension by variously designed steel springs such that the door handle, whose square extends through the follower, is held in a predetermined position and returns to the initial position under spring load after its actuation.

Upon actuation of the door handle a predetermined spring force holding the follower in its initial position must be overcome to withdraw the spring bolt by the limited radial movement of the follower. By the withdrawal of the spring bolt the locking action of the spring bolt is eliminated and the door can be opened.

The spring of the spring bolt always urges the spring bolt into closing position. The tumbler spring likewise exerts a bias on the tumbler to urge it into a position locking the dead bolt.

The spring of the spring bolt and the tumbler springs are dimensioned such that their spring action can be easily overcome, firstly by the slope of the spring bolt head and secondly by the rotary movement of the key whereby the key bit lifts the spring-loaded tumbler out of its arresting position to allow the dead bolt to be shifted forward.

The follower spring designed as a spiral spring or as a so-called flat spiral spring in all embodiments is designed such that the follower spring is arranged in the lock case independently of the follower and transmits its spring action to the follower via more or less bias. The spring of the spring bolt is a flat spiral spring or flat spring and is positioned at a suitable location in the lock case. The same applies to the tumbler spring.

In simple so-called staple locks the springs for the spring bolt and for the tumbler are joined to a combination spring and manufactured in the form of a bent leaf spring. In some embodiments this spring is supported or mounted at a suitable location in the lock case. In further embodiments the combination spring is supported directly on the dead bolt.

In order to offer a possibility of mounting door plates, roses or the like bores both in the lock case bottom and in the lock cover are provided in most types of locks especially in mortise locks. However, all these bores are dimensioned such that any screws or the like extending therethrough will have much clearance. There cannot be mention of a guiding function.

The known lock constructions are relatively expensive to manufacture and partially consist of expensive individual parts. In order to cut expenses the most important functional parts have been modified in a not particularly ideal way. Despite all attempts towards less expensive manufacture certain manual operations cannot be eliminated altogether, and the desire to cut costs ultimately has adverse influences on the quality. Dimensional tolerances in an order of magnitude that is hardly still acceptable are the inevitable consequences.

The invention seeks to overcome these difficulties. The invention as characterized in the claims solves the problem of providing a door lock comprising two case parts disposed in parallel opposed relationship in which the follower is designed as a thermoplastic injection molded part resilient in itself such that, with the follower mounted in the lock case in inoperative position, a partial surface of the follower body bears against a stop face provided in the lock case, and a follower portion extending like an arm from the follower body resiliently rests either indirectly or directly on a further abutment provided in the lock case, or bears against the case wall, upon radial rotary movement of the follower so as to be partially bent inwardly or outwardly and releases lateral shifting of the spring bolt, and the spring for spring bolt and tumbler is formed by a further part whose two free legs are integrally joined with a base structure, and the oppositely disposed lock case parts are provided with sleeves above and below the handle follower.

The problem is further solved by the features characterized in claims 1 to 17.

The subject matter of the invention is illustrated in examples in that

Figure 2:
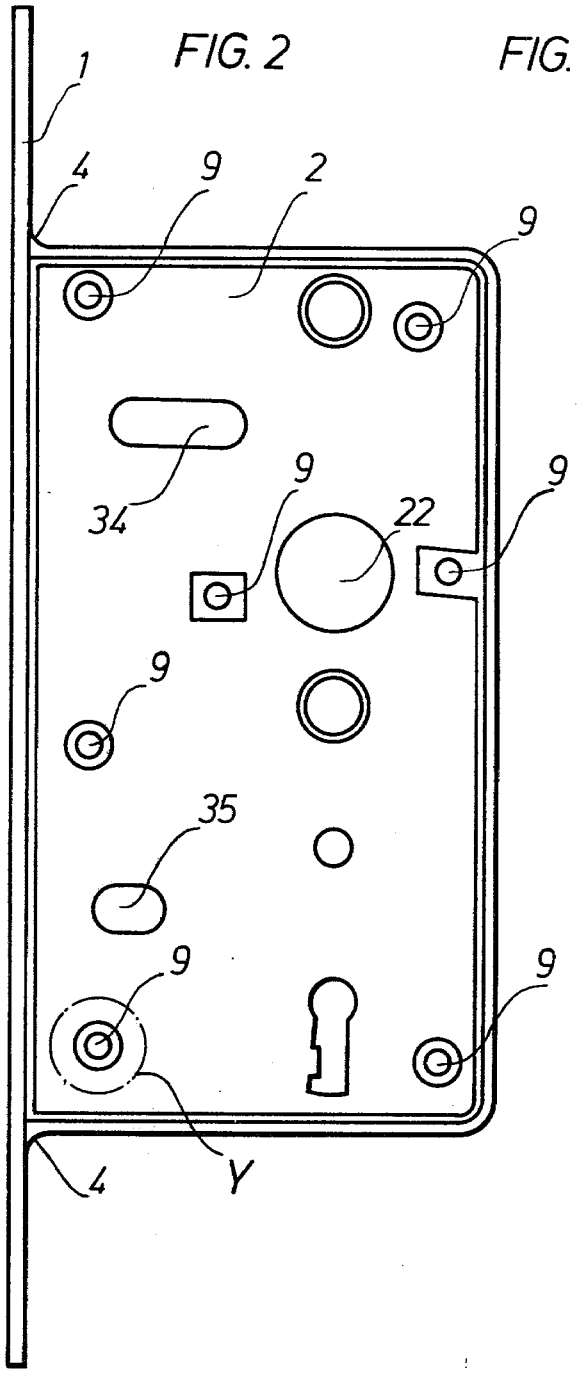
FIG. 2 is a plan view of the lock showing the case without interior parts.
Figure 3:
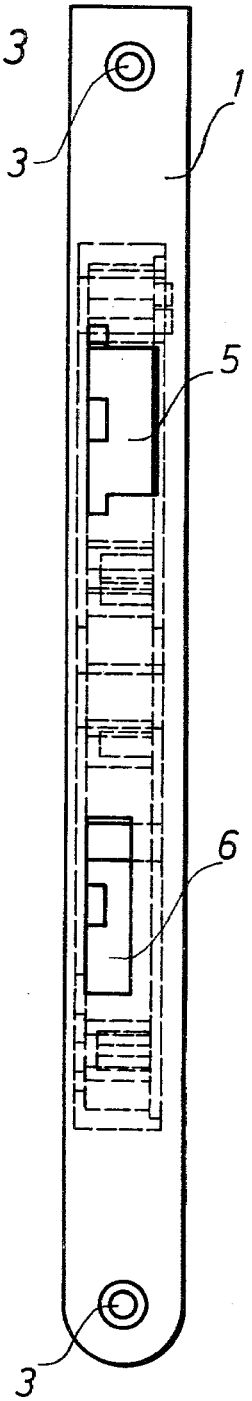
FIG. 3 is a front view of FIG. 2 turned through an angle of 90°.

The lock shown in FIG. 2 comprising the forend plate 1 (FIGS. 2 to 4) and the lock case 2 (FIGS. 2 and 4) is injection molded in a single piece from thermoplastic resin as is being similarly done already, the front piece 1 (FIGS. 2 to 4) being either angular or round, as shown in FIG. 3.

Figure 1:
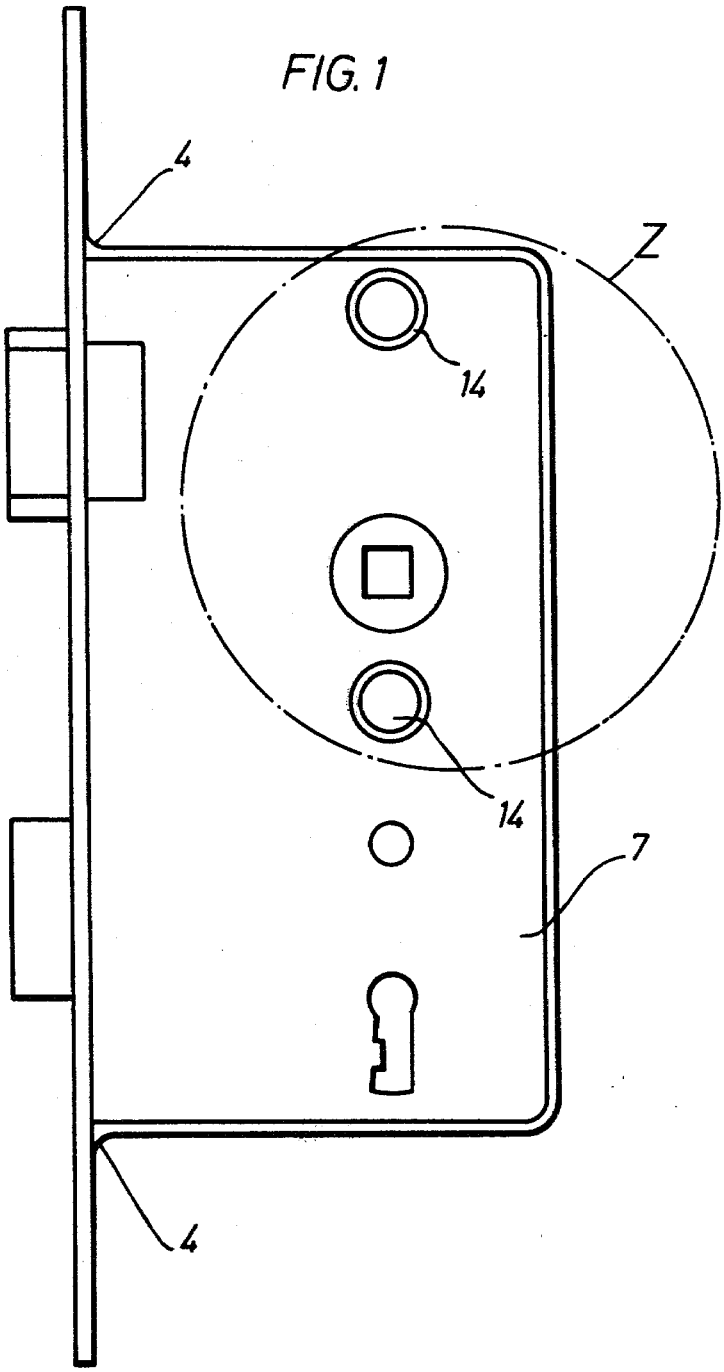
FIG. 1 shows a simplified plan view of the door lock.
Figure 4:
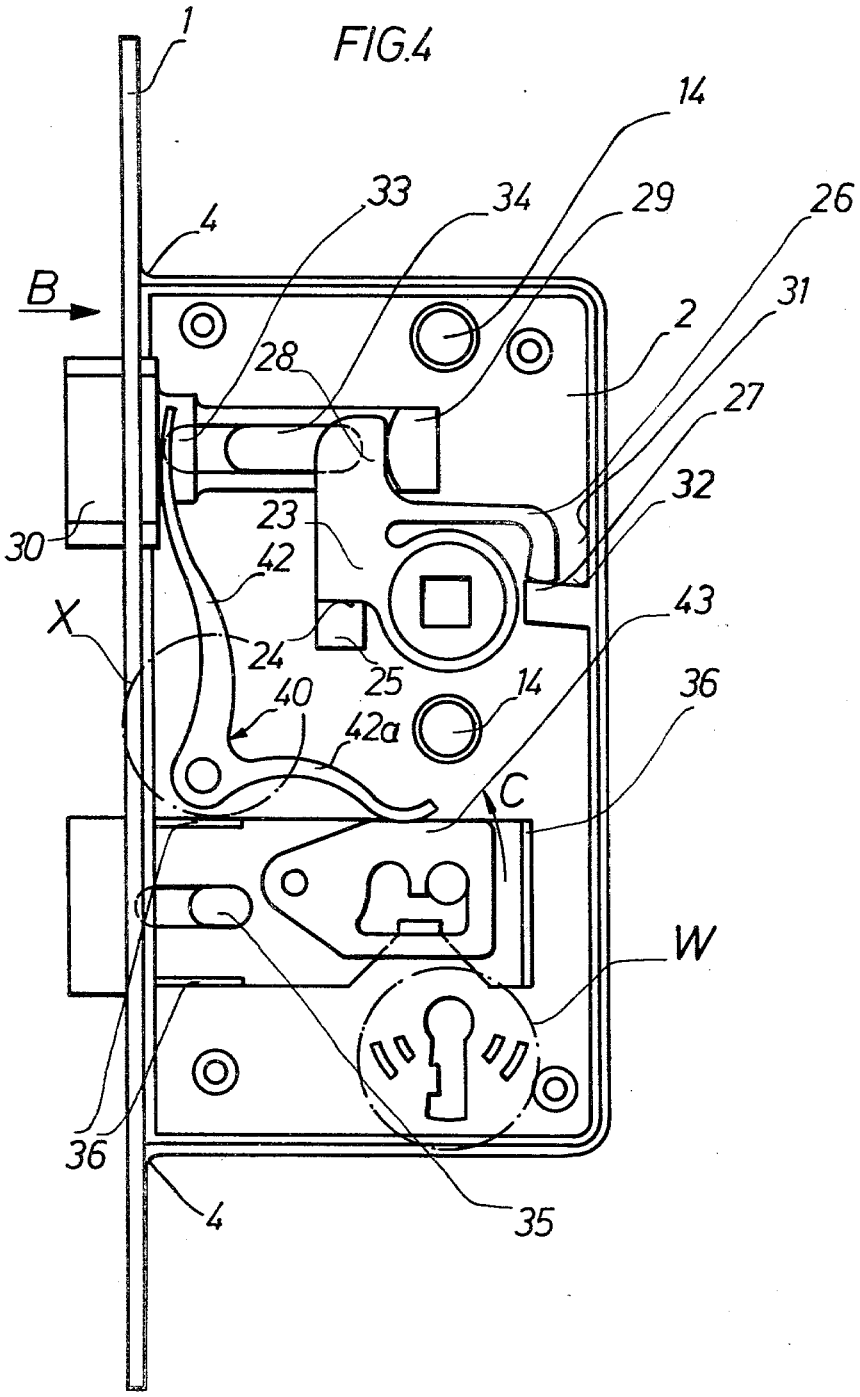
FIG. 4 is a plan view of the door lock with cover removed but with interior parts installed.
Figure 5:
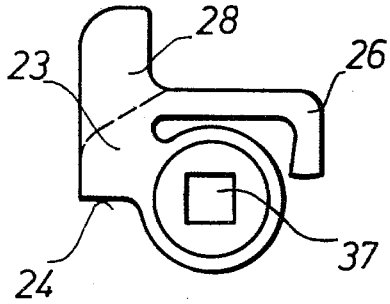
FIG. 5 is a plan view of an exemplary embodiment of the follower.

The holes 3 (FIG. 3) for the screws are produced already during the molding operation. In order to exclude any incision the transition from the lock case to the front piece is suitably provided with radii 4 (FIGS. 1, 2 and 4).

Figure 33:
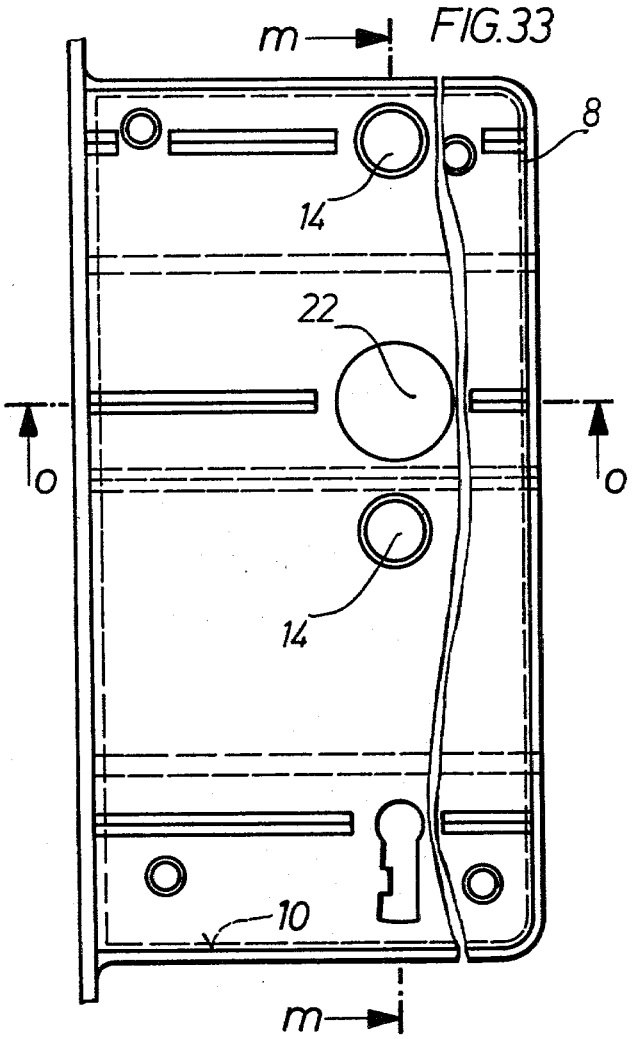
FIG. 33 is a plan view of the lock without interior parts but with cover.
Figure 34:
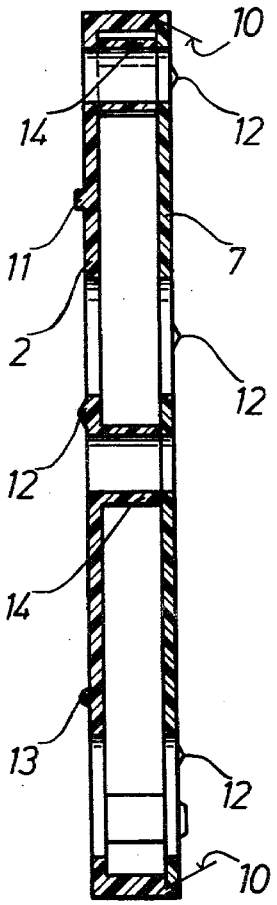
FIG. 34 is a cross section along the line m—m.
Figure 35:
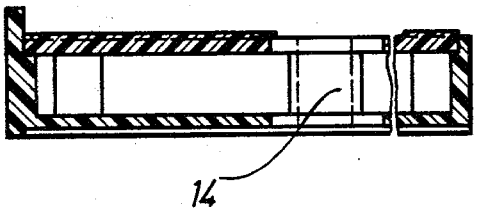
FIG. 35 is a cross section along the line o—o.

The forend plate 1 (FIG. 3) has an opening 5 for the spring bolt and an opening 6 for the dead bolt. These two openings correspond to the dimensions of the spring bolt and of the dead bolt, being dimensioned somewhat larger to avoid jamming of either the spring bolt or the dead bolt. The lock case is suitably designed as a closed box frame construction for reasons of stability, and has a ledge 8 (FIG. 33) extending around the case walls and lowered a distance corresponding to the thickness of the lock cover 7 in order to secure the lock cover (FIGS. 1 and 34). The supporting ledge may also be discontinuous.

Figure 21:
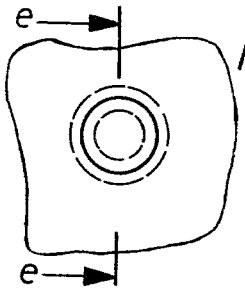
FIG. 21 is a partial view of the lock cover mounting in the region Y (FIG. 2)
Figure 22:
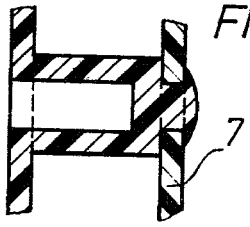
FIG. 22 is a cross section along the line e—e.

The lock cover may be connected to the lock case in many ways. Thus, for instance, pins 9 (FIG. 2) may be provided in the lock case which may be designed as shown in FIGS. 21 and 22. The connection between the lock cover and the case is effected by welding the projecting pin ends which are then deformed as shown in FIG. 22.

Figure 23:
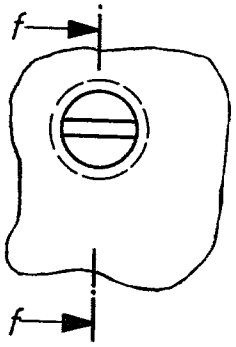
FIGS. 23 to 28 show further plan views of and cross sections through further embodiments.
Figure 24:
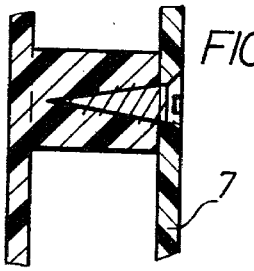

A screw connection is likewise possible, as shown in FIGS. 23 and 24.

Figure 25:
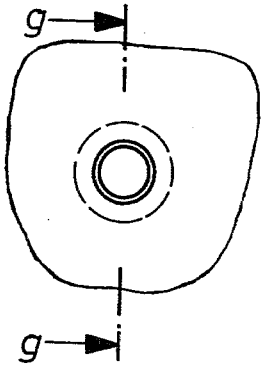
Figure 26:
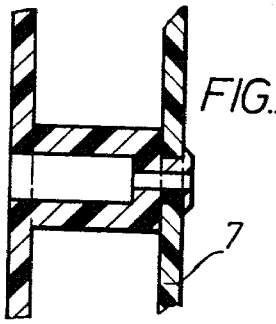

The embodiment of FIGS. 25 and 26 allows more rapid assembly. There the projecting pin ends are undercut to thereby engage the lock cover 7 (FIG. 26) after application of the latter.

Figure 27:
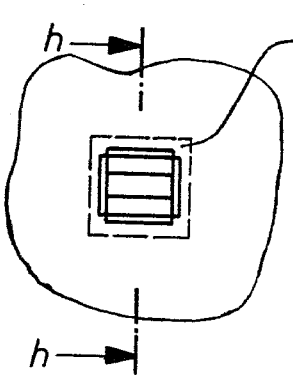
Figure 28:
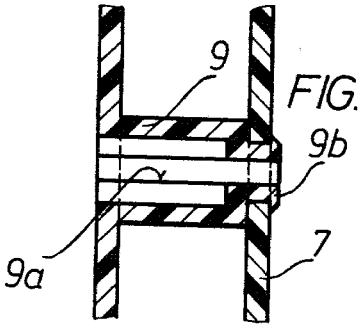
Figure 29:
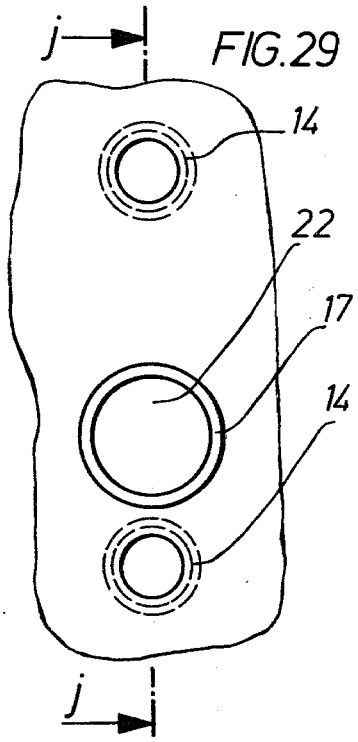
FIG. 29 shows a partial view in the region Z of the lock (FIG. 1)

The most advantageous solution is offered by the mode of connection shown in FIGS. 27 and 28, especially when harder types of plastic are used. The pin 9 (FIGS. 27 and 28) has a rectangular or square cross section. The pin 9 itself has a coextensive slot 9*a* (FIG. 28) which ensures good engagement of the tabs 9*b* (FIG. 28). After mounting of the interior parts the lock cover is snapped into undercuts 10 (FIG. 34) along the two parallelly disposed shorter sides by bending the cover longitudinally and then allowing it to stretch again and snap into the undercuts of matching dimensions, in addition to the engagement by the pins 9.

The lock case 2 (FIG. 34) and the cover 7 (FIG. 34) are provided with ribs 11, 12 and 13 (FIG. 34) extending transversely of the forend plate.

It is well known that there is always a clearance between the pocket provided in the door and the lock case to be accommodated therein. As a consequence, the lock is held substantially only at the forend plate, a disadvantage which later may cause premature wear of the follower and finally also loosening of the entire fitting. The ribs 11, 12 and 13 (FIG. 34) may also be discontinuous. Said ribs secure the lock firmly in the accommodating pocket, and the narrow supporting surface provided by the ribs permits precise adjustment between pocket width and lock case thickness, because the relatively narrow supporting surfaces will easily overcome the resistance of the wood, particularly when the ribs 12 are designed as shown in FIG. 34.

In this case there is substantially only line contact. Finally, in the lock case there are sleeves 14 (FIGS. 1, 4, 29, 30, 33, 34 and 35) which, in turn, are surrounded by sleeves 15 (FIG. 30) on the inside of the lock cover.

Figure 30:
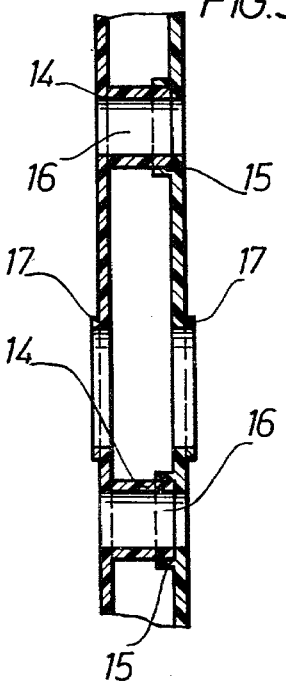
FIG. 30 is a cross section along the line j—j.

Both sleeves, those at the lock case and those at the cover, define a common bore 16 (FIG. 30 ). These interior bores may be round or angular or of other configuration.

The sleeves 14 and 15 with the interior bores 16 may serve as supports for a fitting to be mounted at the door later on.

Figure 6:
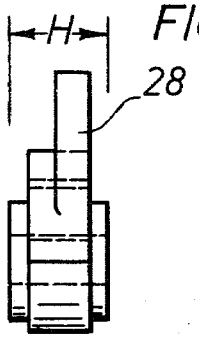
FIG. 6 is a side view of FIG. 5 turned through an angle of 90°.
Figure 7:
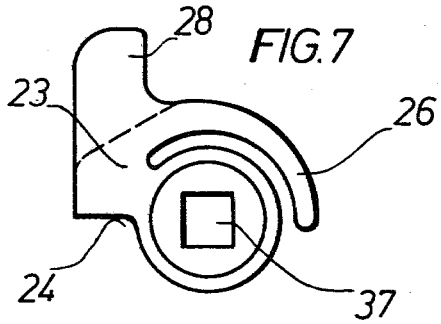
FIGS. 7 to 10 are further plan views of further examples.
Figure 8:
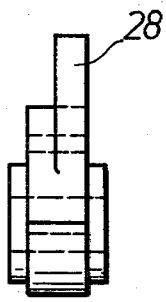
Figure 9:
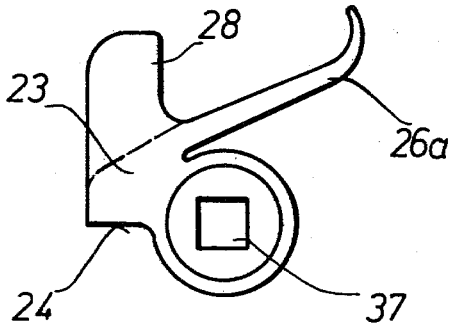
Figure 10:
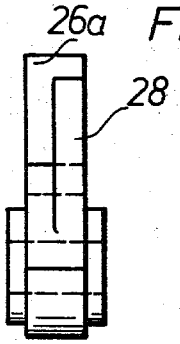

In order that the follower can be readily rotated unimpededly a projecting collar 17 (FIGS. 29 and 30) is provided both at the lock case and at the back cover in the region of the follower support; the total height of said collar together with the cover and the case is greater than the height (H) of the follower FIG. 6.

Finally, the key for the lock of the invention is also made from thermoplastic material.

Figure 31:
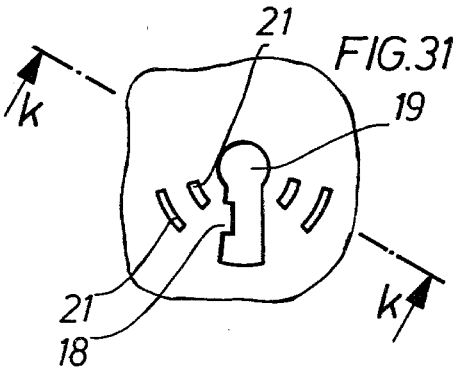
FIG. 31 shows a partial view in the region W (FIG. 4)

Keys manufactured from thermoplastic material have been known per se. However, in the present construction the key does not exhibit any further shaping such as is conventional in the so-called single tumbler lock keys. The only exception is a recess matching the recess 18 (FIG. 31) in the lock case and in the lock cover.

Figure 32:
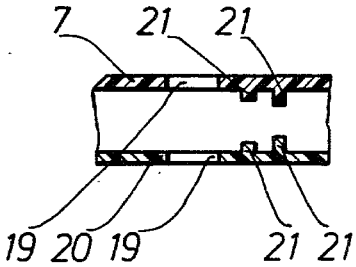
FIG. 32 is a cross section along the line k—k.

Beside the keyhole 19 (FIGS. 31 and 32) ring sections 21 (FIGS. 31 and 32) of different diameters are provided symmetrically on the left and right hand side of the keyhole which may differ in diameters and heights.

This difference of the ring sections offers at the same time various locking possibilities if the key bits has matching circular grooves in its front side.

The ring sections in the lock case bottom and on the inner side of the lock cover also afford a certain degree of protection against unauthorized opening of the lock with so-called skeleton keys.

The different arrangement of the ring sections offers a sufficient number of locking possibilities.

The follower designed according to the invention is supported in the bore 22 (FIGS. 2, 29, 33) both in the lock case bottom and in the lock cover. The follower shown in FIGS. 5 to 10 has a stop 23 whose surface 24, in mounted condition, bears against a small stop 25 block or stop bar (FIG. 4), while at the same time the fork-like portion 26 (FIGS. 4, 5 to 8) rests with its straight or bent end on an abutment 27 (FIG. 4).

The arm 28 of the follower (FIGS. 4, 5 to 10) is suitably stepped, as shown in FIGS. 6 to 10, and bears against the thicker spring bolt tail 29 (FIG. 4) in order to be able to laterally shift the spring bolt 30 (FIG. 4) upon radial rotation of the follower.

The thickened portion 29 (FIG. 4) of the spring bolt tail is rounded at the surface facing the spring bolt head. This offers the advantage of permitting easier lateral shifting of the spring bolt as the friction between follower arm and spring bolt tail is reduced. In the follower construction shown in FIGS. 9 and 10 the fork-like portion 26*a* is designed such that the end indirectly or directly bears against the lock case 31 (FIG. 4) for support.

In the follower construction shown in FIGS. 5 to 10 the fork-like lever arm 26 bends upwardly upon radial rotation of the follower thereby developing spring-like action.

Suitably the free or bent end of the fork-like portion 26 slides along an inclined surface 32 (FIG. 4) or along the lock case wall 31 (FIG. 4).

Figure 11:
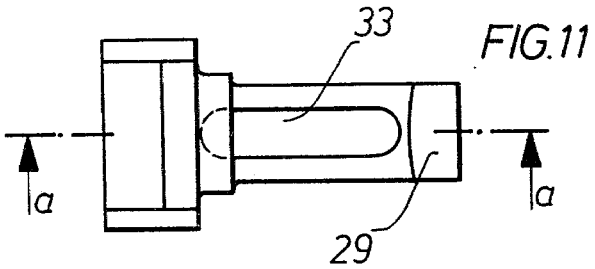
FIG. 11 is a plan view of the spring bolt.
Figure 12:
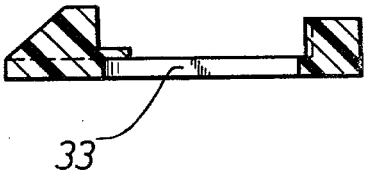
FIG. 12 is a section along the line a—a.

The follower 30 (FIG. 4) has a groove 33 ending below the spring bolt head (FIGS. 11 and 12). A rib 34 (FIGS. 2 and 4) provided in the lock case bottom guides the spring bolt and at the same time limits the return movement thereof.

A further guide rib 35 (FIG. 2) is provided in the case bottom for better guidance of the dead bolt.

Figure 13:
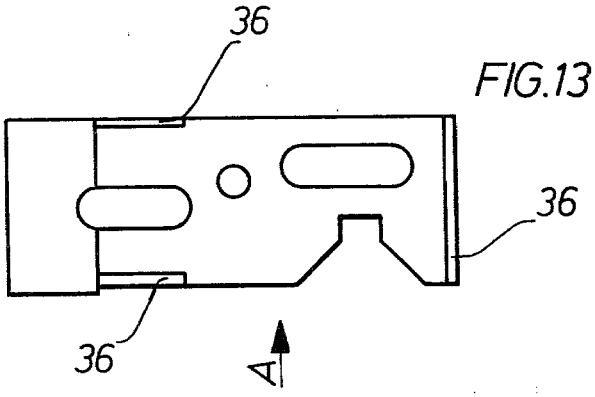
FIG. 13 is a plan view of the dead bolt.
Figure 14:
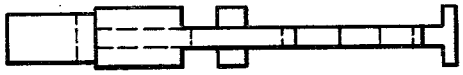
FIG. 14 is a plan view in the direction A.

Ribs 36 provided laterally and at the end of the dead bolt (FIGS. 4 and 13) effectively prevent tilting of the dead bolt in the lock case because said ribs slide both along the bottom of the lock case and along the inside of the lock cover during the locking operation.

Figure 15:
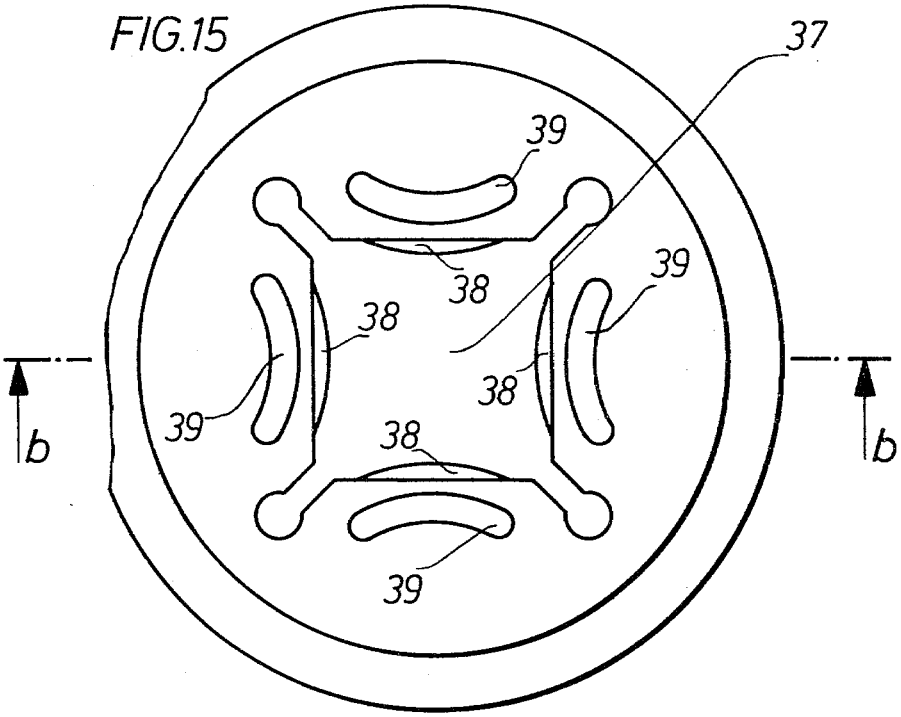
FIG. 15 is an enlarged partial view of the follower in the region of the square bore.

The square bore 37 (FIGS. 5, 7, 9 and 15) is diagonally slitted as shown in FIG. 15 and has curvatures on all four interior faces which are designed such that they end both in horizontal and in vertical direction.

Figure 16:
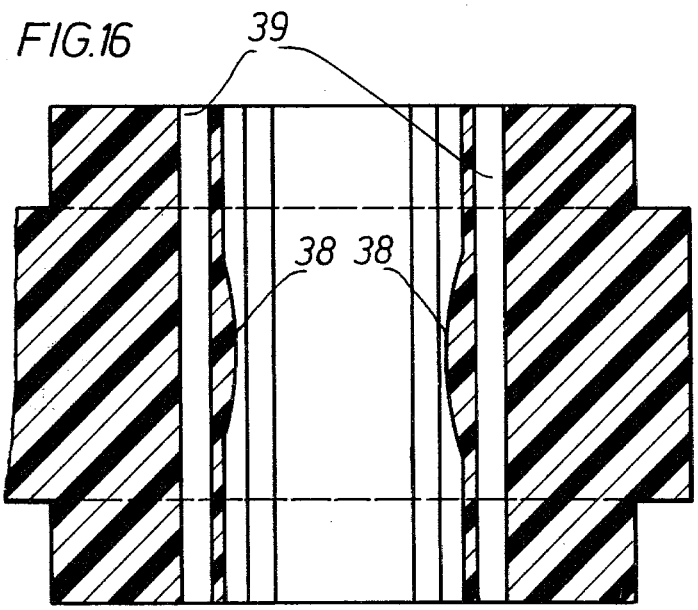
FIG. 16 is a cross section along the line b—b.

Recesses 39 (FIGS. 15 and 16) allow the curvatures 38 (FIGS. 15 and 16) to spring back as the door handle square is inserted and assist in firmly gripping the door handle square.

Figure 17:
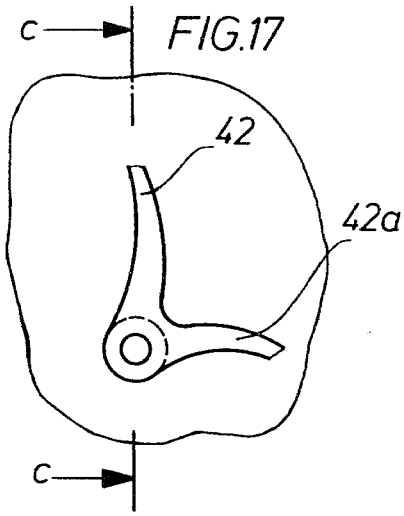
FIG. 17 is a partial view of the combined spring bolt-and-tumbler spring in the region X (FIG. 4)
Figure 18:
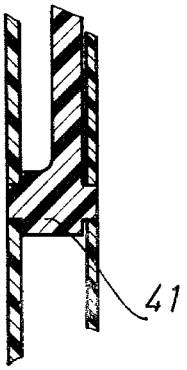
FIG. 18 shows a cross section along the line c—c which also extends through the lock cover not shown in FIG. 17.
Figure 19:
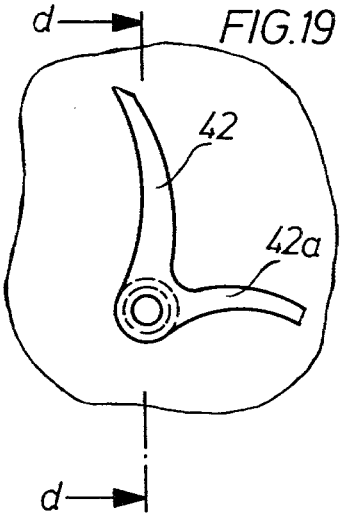
FIGS. 19 to 20 are a further plan view of and cross section through a further embodiment.
Figure 20:
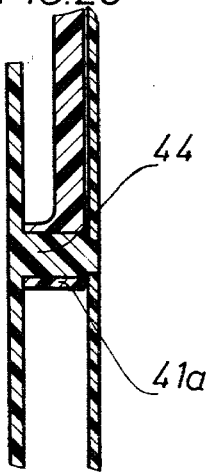

The spring bolt-and-tumbler spring 40 (FIG. 4) is designed such that two legs 42 and 42*a* (FIGS. 4, 17 and 19) extend from a base structure 41 (FIG. 18), 41*a* (FIG. 20) with curved leg ends bearing for support both against the spring bolt head 30 (FIG. 4) and against the tumbler 43 (FIG. 4), and developing spring action upon movement of the spring bolt in the direction (B) (FIG. 4), which is promoted by the fact that the leg 42*a* increasingly bears against the tumbler 43 (FIG. 4). On the other hand, the leg 42 (FIG. 4) exerts increasing spring action on the leg 42*a* when the tumbler moves in the direction (C).

The mutual spring assistance is enhanced by the fact that the base structure 41 (FIG. 18) and 41*a* (FIG. 20) is rotatably supported at a suitable location in the lock case.

This support may be effected such that two stepped pins at the base structure are rotatably supported both in the lock case bottom and in the lock cover, or else that the base structure 41*a* (FIG. 20) has a bore rotatably engaging the pin 44 (FIG. 20) at the lock case bottom.

Suitably the base structure is of a height corresponding approximately to the free space between lock case bottom and lock cover and the fork-like legs 42 and 42*a* are stepped according to requirements.

I claim:

1. A door lock comprising two lock case parts disposed in parallel opposed relationship and forming a lock case, an injection molded resilient thermoplastic material follower mounted in the lock case and moveable therein between inoperative and operative positions, the follower having a body part which in the follower inoperative position is engaged against a stop bar in the case, said follower further having a lever-like follower leg, said lock further including a spring bolt, a tumbler and a spring member engageable with both said spring bolt and said tumbler, radial rotative movement of the follower to an operative position causing lateral shifting of the spring bolt, characterized in that the follower leg forks off the follower body part and bears against an abutment structure in the lock case, said follower leg resiliently bending outwardly relative to the body part upon radial rotary movement of the follower from inoperative to operative positions, the spring bolt and tumbler spring member being a structure having free legs which are integral with a base structure, one leg of said spring member engaging the spring bolt and the other the lock tumbler.

2. A door lock according to claim 1 in which the follower leg is bent at its free end and rounded at the tip of said free end, the lock case abutment structure having an inclined supporting surface on which said free end tip slides.

3. A door lock according to claim 2 in which the follower has a square bore passage therein, said passage being diagonally slitted at the corners thereof, the surfaces of said bore having curvatures thereon there further being openings in the follower body adjacent to and parallel with the bore surfaces to permit the bore defining structure to yield on insertion of a door handle rod in said bore and to spring back for tightly gripping the said rod.

4. A door lock according to claim 1 in which one of the lock case parts carries a pair of sleeves extending toward the other lock case part and arranged on opposite sides of the location of the follower within the lock case.

5. A door lock according to claim 4 in which the other lock case part carries two sleeves concentric with the pair of sleeves carried in the first-mentioned lock case part.

6. A door lock according to claim 1 in which ribs are carried on the outside of the lock case to facilitate precise positioning of the lock in a door pocket.

7. A door lock according to claim 1 in which the lock case is provided with aligned collars at the outer sides of said case parts for rotatably receiving said follower.

8. A door lock according to claim 1 in which one lock case part snaps into undercuts provided in the other lock case part.

9. A door lock according to claim 1 in which pins are provided on one lock case part and which pins engage in openings in the other lock case part for securing said case parts together.

10. A door lock according to claim 9 in which the pins each have tip end nose tabs and an elongated slit therein.

11. A door lock according to claim 1 in which ring sections of different height and different diameters are carried on the lock case interiorly thereof and adjacent a lock case keyhole opening.

12. A door lock according to claim 1 in which the free legs of said spring bolt and tumbler spring member are curved at their ends.

13. A door lock according to claim 12 in which the base structure of the spring bolt and tumbler spring member is thicker than the free legs thereby to permit precise positioning of said spring member between the two lock case parts.

14. A door lock according to claim 1 in which said lock includes a dead bolt and ribs are provided on one of the lock case parts for guiding the spring bolt and the dead bolt, the rib for guiding the spring bolt simultaneously limiting the movement of the spring bolt and partially entering a head part of the spring bolt when the spring bolt is in retracted position.

15. A door lock according to claim 1 in which all parts thereof are injection molded resilient thermoplastic material components.

* * * * *